US007900492B2

(12) United States Patent
Komatsu

(10) Patent No.: US 7,900,492 B2
(45) Date of Patent: Mar. 8, 2011

(54) METHOD FOR PRESS FORMING OF A PANEL PART HAVING A BENT PORTION AND PRESS FORMING DEVICE

(75) Inventor: Junichi Komatsu, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 356 days.

(21) Appl. No.: 11/992,946

(22) PCT Filed: Oct. 5, 2006

(86) PCT No.: PCT/IB2006/002858

§ 371 (c)(1),
(2), (4) Date: Apr. 1, 2008

(87) PCT Pub. No.: WO2007/039817

PCT Pub. Date: Apr. 12, 2007

(65) Prior Publication Data

US 2009/0126448 A1 May 21, 2009

(30) Foreign Application Priority Data

Oct. 5, 2005 (JP) ..... 2005-292772

(51) Int. Cl.
*B21D 22/00* (2006.01)

(52) U.S. Cl. ..... 72/348; 72/347

(58) Field of Classification Search ..... 72/347, 72/348, 350, 379.2, 349
See application file for complete search history.

(56) References Cited

U.S. PATENT DOCUMENTS

| | | | | |
|---|---|---|---|---|
| 2,824,594 | A | 2/1958 | Gray | |
| 4,121,448 | A * | 10/1978 | Censuales | 72/348 |
| 4,890,471 | A * | 1/1990 | Ito | 72/348 |
| 5,263,887 | A * | 11/1993 | Cagna et al. | 445/47 |
| 5,600,991 | A * | 2/1997 | Munzen | 72/348 |

FOREIGN PATENT DOCUMENTS

| | | |
|---|---|---|
| CN | 1342532 A | 4/2002 |
| EP | 1 415 735 A1 | 5/2004 |

(Continued)

OTHER PUBLICATIONS

Russian "Decision on Granting a Patent for Invention," dtd Sep. 29, 2008.

(Continued)

*Primary Examiner* — Edward Tolan
(74) *Attorney, Agent, or Firm* — Finnegan, Henderson, Farabow, Garrett & Dunner, LLP

(57) ABSTRACT

An addendum shape portion of a panel material is drawn by a drawing portion of a press forming die by an amount equal to or less than the limit to which the panel material can be drawn, whereby a to-be-product portion of the panel material is roughly conformed to a forming face of a punch. In this state, the to-be-product portion of the panel material is stretched or drawn. Accordingly, the cross section of the to-be-product portion is uniformly changed at the minimum level, which makes it possible to produce, by press forming, a fender panel made of aluminum base alloy, which has a great plane dimension L and high quality. As a result, flexibility in the design of panel parts, which are formed by pressing the panel material into shapes, is increased.

8 Claims, 6 Drawing Sheets

FOREIGN PATENT DOCUMENTS

| | | |
|---|---|---|
| JP | 56-34616 | 4/1981 |
| JP | 57-184531 | 11/1982 |
| JP | 1-306022 | 12/1989 |
| JP | 2-121727 | 5/1990 |
| JP | 7-63766 | 7/1995 |
| JP | 10-043820 | 2/1998 |
| JP | 2000-42645 | 2/2000 |
| JP | 2001-58218 | 3/2001 |
| JP | 2004-188445 | 7/2004 |
| JP | 2004-188445 A | 7/2004 |
| JP | 2004-358553 | 12/2004 |
| RU | 2057607 C1 | 4/1996 |
| SU | 659238 A | 4/1979 |
| SU | 1738426 A | 6/1992 |

OTHER PUBLICATIONS

International Search Report, Feb. 14, 2007.
Written Opinion of the ISR, Jan. 2, 2008.

* cited by examiner

METHOD FOR PRESS FORMING OF A PANEL PART HAVING A BENT PORTION AND PRESS FORMING DEVICE

INCORPORATION BY REFERENCE

The disclosure of Japanese Patent Application No. 2005-292772, filed on Oct. 5, 2005, including the specification, drawings, and abstract is incorporated herein by reference in its entirety.

BACKGROUND OF THE INVENTION

1. Field of the Invention

The invention relates generally to a press forming method and a press forming device. More specifically, the invention relates to a press forming method for press-forming a panel part made of aluminum base alloy, and a press forming device that is used to perform the press forming method.

2. Description of the Related Art

In recent years, the needs for vehicles having lighter weights have been growing. In light of such situation, more expectations have been placed on increases in the use of panel parts (hood panels, fender panels, etc.) made of aluminum base alloy. A panel material made of aluminum base alloy (a panel material made of aluminum base alloy will be simply referred to as an "aluminum material" in the following description, although it will be sometimes referred simply to as a "panel material") has a yield strength and a tensile strength that are at substantially the same levels as those of commonly used mild steels. Meanwhile, an elongation and a strain value (r value) of the aluminum material are lower than those of the commonly used mild steels. Accordingly, the aluminum material and the mild steels are greatly different from each other in the manner in which they respond to the press forming. A lot of attention is required when the aluminum material is pressed into shapes. Generally, as shown in FIG. 9, when an aluminum material 11 is pressed into shapes to form a fender panel 1, a press direction and a die face, which are used during the press forming, are set using a plain face Q including three points P1, P2, and P3 of the fender panel 1, as a reference face. In this case, the limit to which the aluminum material 11 can be drawn is approximately 200 mm (i.e., the aluminum material 11 can be drawn by 200 mm at the maximum). In addition, changes in the cross section of the aluminum material 1, which occur due to the press forming, need to be limited to prevent crinkling and cracking. As a result, the design of the fender panel 1 is significantly limited.

Recently, the variety of design of vehicle bodies has been increasing. Due to such increases, a dimension of the fender panel 1, produced by the press forming, on a given plane face when viewed from the top of the fender panel 1 (hereinafter, such dimension will be referred to as a "plane dimension") may be equal to or greater than 500 mm. When the aluminum material 11 is pressed into shapes to form the fender panel 1 having a great plane dimension, a maximum drawing depth S1, at which the aluminum material 11 is drawn by the maximum amount (see FIG. 9), significantly exceeds the limit to which the aluminum material 11 can be drawn. As a result, cracking occurs. Also, when the aluminum material 11 is pressed into shapes to form the fender panel 1 having a great plane dimension, the press forming is started from the center of a portion at which the aluminum material 11 is drawn by the maximum amount. Accordingly, as shown in FIG. 10, the portion of the aluminum material 11, which will be the fender panel 1, is not pressed uniformly. In addition, a punch (a lower die) and the aluminum material 11 contact each other at a point. As a result, crinkling occurs in a product. Clinking and cracking can be prevented to some extent by, for example, appropriately arranging the die face and an addendum shape portion and adjusting the amount of flow of the material caused by the press forming. However, when the cross section of a bent portion greatly changes, for example, when the fender panel 1 having a great plane dimension is formed from the aluminum material 11, occurrence of clinking and cracking cannot be prevented.

Japanese Patent Application Publication No. JP-A-2004-188445 describes a method for pressing an aluminum base alloy plate into shapes. According to this method, an end portion of the aluminum base alloy plate is bent in advance to form a bent portion. This bending process is performed so that, a portion, that is included in the end portion of the aluminum base alloy plate, the end portion being formed into the bent portion, and that is in contact with a binder surface (die face) during the press forming, is roughly conformed to a surface of a blank holder during the press forming. Then, the aluminum base alloy plate is pressed into shapes, while blank holding is performed on the aluminum base alloy plate including the portion of the bent portion, which is in contact with the binder surface during the press forming. However, the described method does not make it possible to uniform the drawing depth if the cross section of the bent portion greatly changes, for example, if the fender panel 1 having a great plane dimension is formed from the aluminum base alloy plate. As a result, the portion of the aluminum base alloy plate 11, which will be the fender panel 1, is not pressed uniformly, causing crinkling in a product. If superplastic forming (blow forming) is adopted here, the fender panel 1 made of aluminum base alloy, which has a great plane dimension and high-quality, can be produced. However, aluminum material for superplastic forming is more expensive than aluminum material for press forming. As a result, performing superplastic forming increases production cost.

In addition, the cycle time of the superplastic forming is longer than that of the press forming. Therefore, performing the superplastic forming significantly reduces the production efficiency (for example, although the cycle time when the fender panel 1 made of aluminum base alloy is produced by press forming is 7.5 seconds per one piece, the cycle time when the fender panel 1 made of aluminum base alloy is produced by superplastic forming is 5 minutes per one piece). Alternatively, the fender panel 1 may be produced by brazing a plain face portion and a side face portion to each other, which are individually formed by press forming. However, this method does not provide any of high quality, high production efficiency (the cycle time when the fender panel 1 made of aluminum base alloy is produced by this method is three hours per one piece) and high cost performance (multiple types of dies are required).

DESCRIPTION OF THE INVENTION

The invention is made in light of the above-described circumstances. The invention provides a press forming method with which flexibility in the design of panel parts, formed by pressing aluminum materials into shapes, is increased. The invention also provides a press forming device with which flexibility in the design of panel parts, formed by pressing aluminum materials into shapes, is increased.

A first aspect of the invention relates to a method for press-forming a panel part having a bent portion. According to the method, a panel material is bent along a portion, which will be the bent portion of the panel part, so that the panel material is placed along a forming face of a punch. A restraint-target portion of the panel material, which is set along the periphery of the panel material, is restrained with the panel material placed along the forming face of the punch. An addendum shape portion of the panel material, which is set on the inner side of the restraint-target portion and which surrounds a to-be-product portion of the panel material, is drawn by an amount that is equal to or less than the limit to which the panel material can be drawn so that the to-be-product portion of the panel material is roughly conformed to the forming face of the punch. Then, the to-be-product portion of the panel material is stretched or drawn so that the to-be-product portion is formed into a product shape.

In the method according to the first aspect of the invention, the restraint-target portion of the panel material may be restrained onto a die face that is parallel to a plane extending from the forming face of the punch.

In the method according to the first aspect of the invention, the panel material is bent along an apex portion of the punch so that the panel material is divided into two portions that are contiguous with each other.

A second aspect of the invention relates to a press forming device provided with a press forming die that includes an upper die and a lower die, and that forms a panel part having a bent portion. The press forming die includes a restraining portion, a drawing portion, and a product forming portion. The restraining portion restrains a restraint-target portion of a panel material, which is set along the periphery of the panel material, with a portion of the panel material, which will be the bent portion of the panel part, bent along an apex portion of a punch. The drawing portion draws an addendum shape portion of the panel material, which is set on the inner side of the restraint-target portion and which surrounds a to-be-product portion of the panel material, by an amount equal to or less than the limit, to which the panel material can be drawn, with the restraint-target portion of the panel material restrained by the restraining portion. The to-be-product portion of the panel material is roughly conformed to the punch by drawing the addendum shape portion of the panel material using the drawing portion. The product forming portion stretches or draws the to-be-product portion of the panel material with the to-be-product portion of the panel material roughly conformed to the punch.

In the press forming device according to the second aspect of the invention, the restraining portion may have a die face that is parallel to a plane extending from a forming face of the punch.

In the press forming device according to the second aspect of the invention, the punch may have two forming faces that are defined by the apex portion which horizontally extends. The product forming portion that forms one of two contiguous faces of the panel part, which are defined by the bent portion, may be formed in one of the two forming faces. The product forming portion that forms the other of the two contiguous faces of the panel part, which are defined by the bent portion, may be formed in the other of the two forming faces.

With the press forming method and press forming device described above, the portion of the panel material, which will be the bent portion of the panel part, is bent along the apex portion of the punch. In this state, the restraint-target portion of the panel material is restrained, and the addendum shape portion of the panel material is drawn by the amount equal to or less than the limit to which the panel material can be drawn. Thus, the to-be-product portion of the panel material is conformed to the forming face of the punch. Next, the to-be-product portion of the panel material is stretched or drawn by the product forming portion of the press forming die, whereby the to-be-product portion is formed into a product shape.

When the restraint-target portion of the panel material is restrained by the restraining portion, the cross section of the panel material does not change. Accordingly, crinkling does not occur when the restraint-target portion is restrained.

The panel part having two contiguous faces that are defined by the bent portion is formed.

The invention thus provides the press forming method and press forming device with which flexibility of the design of the panel parts, formed by pressing panel materials (aluminum materials) into shapes, is increased.

BRIEF DESCRIPTION OF THE DRAWINGS

The features, advantages thereof, and technical and industrial significance of the invention will be better understood by reading the following detailed description of an example embodiment of the invention, when considered in connection with the accompanying drawings, in which.

DETAILED DESCRIPTION OF THE EXAMPLE EMBODIMENT

Figure 1:
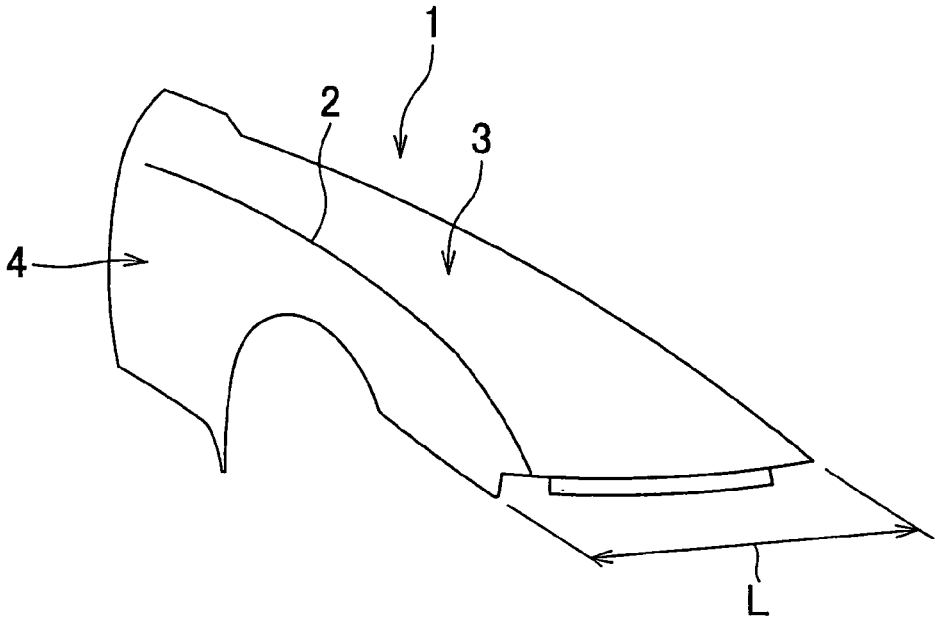
FIG. 1 is the perspective view of a fender panel (a panel part) that is formed by a press forming device according to an embodiment of the invention.
Figure 2:
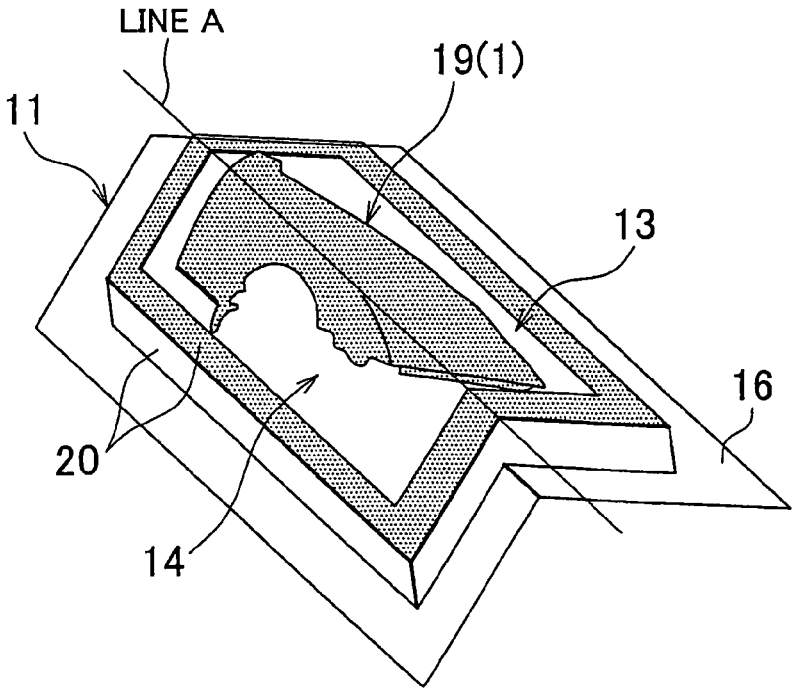
FIG. 2 is the perspective view of an aluminum material from which the fender panel has been formed by the press forming device according to the embodiment of the invention.

In the following description and the accompanying drawings, the invention will be described in more detail with reference to an example embodiment. The embodiment of the invention will be described in detail with reference to FIGS. 1 to 8. In the embodiment of the invention, a press forming device that forms a fender panel 1 made of aluminum base alloy (hereinafter, simply referred to as a "fender panel 1") shown in FIG. 1 will be described. As shown in FIG. 1, the fender panel 1 (a panel part) is bent along a bent portion 2, which defines a plain face portion 3 and a side face portion 4 that are contiguous with each other. The fender panel 1 is formed so as to have a plane dimension L (in the embodiment, the plane dimension L is 630 mm). The press forming device includes an upper die 5 (see FIG. 5) and a lower die 6 (see FIG. 3). The press forming device is provided with a press forming die 7. At the press forming die 7, the orientation of the fender panel 1 is set with respect to the press direction in which the press forming is performed (the vertical direction in FIG. 2) so that a to-be-product portion 19 (a portion that will be formed into a product or an area including the portion that will be formed into the product) of a panel material 11 made of aluminum base alloy (a panel material made of aluminum base alloy will be simply referred to as an "aluminum material 11" in the following description, although it will be sometimes referred simply to as a "panel material 11") is pressed uniformly (the to-be-product portion 19 of the aluminum material 11 is drawn by the minimum amount), as shown in FIG. 2. As shown in FIG. 4, the lower die 6 includes a punch 9 having forming faces 8, and a cushion ring 10 which has a frame-shape and which is arranged so as to surround the punch 9. The punch 9 has an apex portion 12 that supports a portion of the aluminum material 11, which will be the bent portion 2 of the fender panel 1. The portion of the aluminum material 11, which will be the bent portion 2 of the fender panel 1, is bent along a line A (see FIG. 2).

Figure 3:
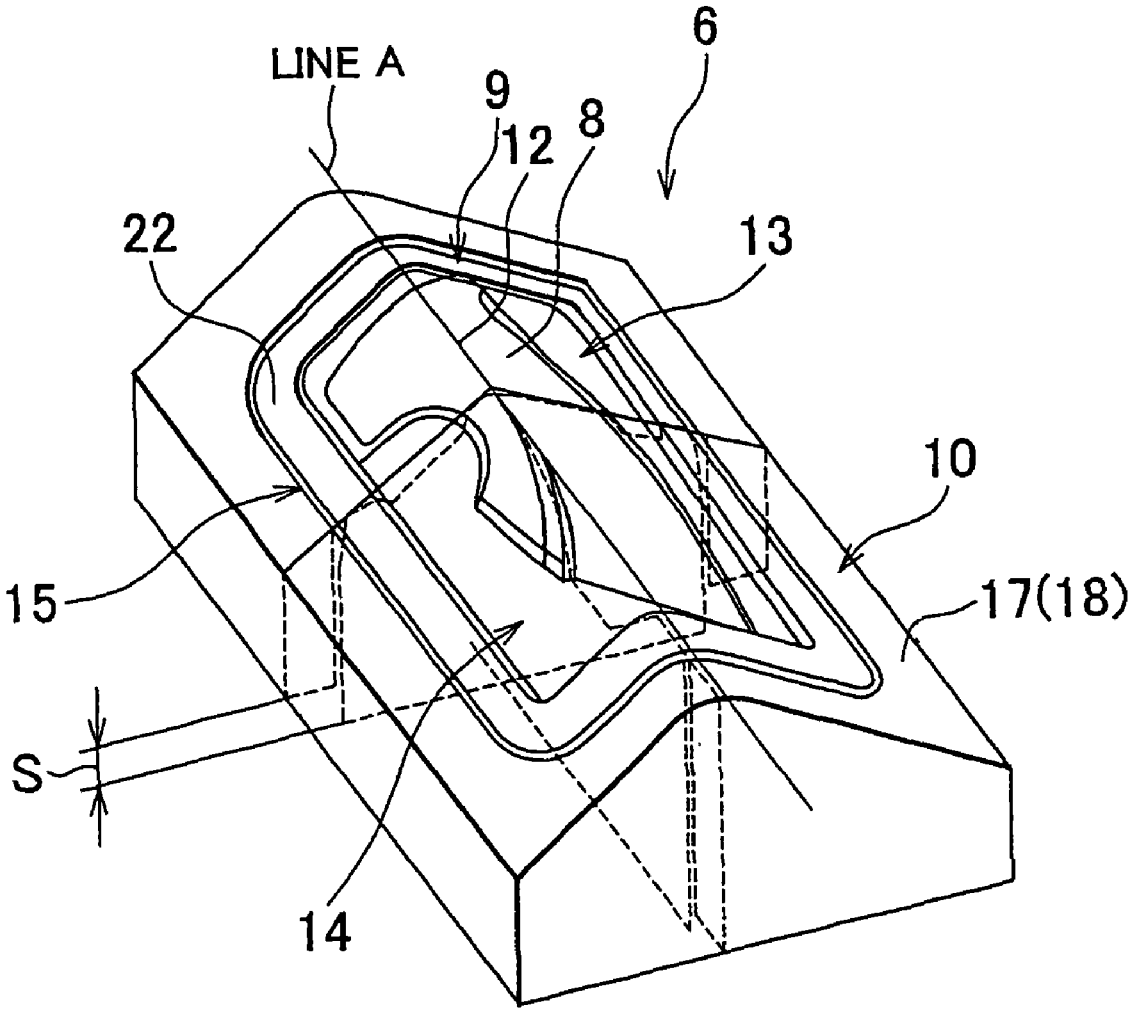
FIG. 3 is the perspective view of a lower die of the press forming device according to the embodiment of the invention, showing the state where the aluminum material is to be restrained onto the lower die.
Figure 4:
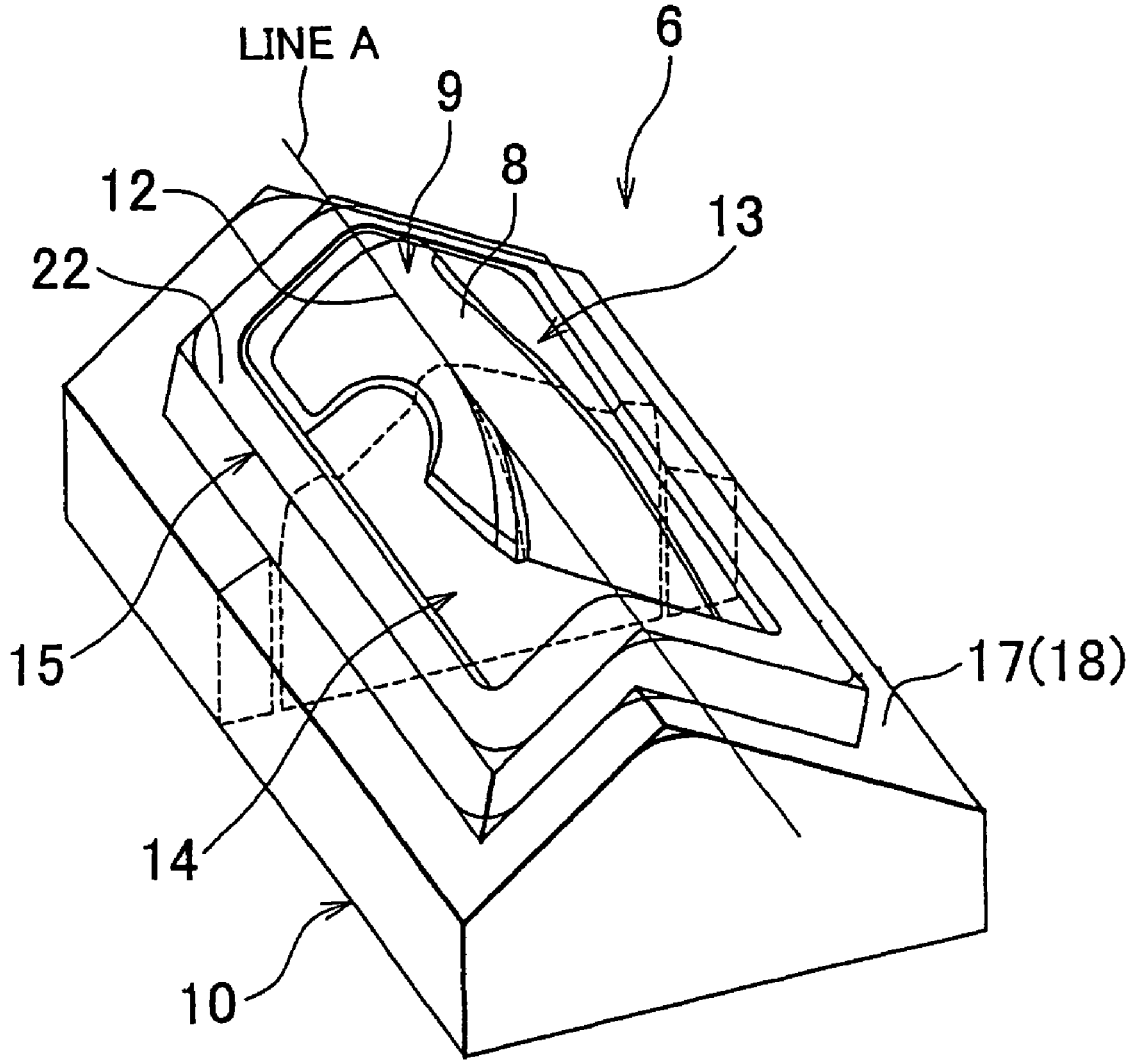
FIG. 4 is the perspective view of the lower die of the press forming device according to the embodiment of the invention, showing the state where press forming has been completed.
Figure 5:
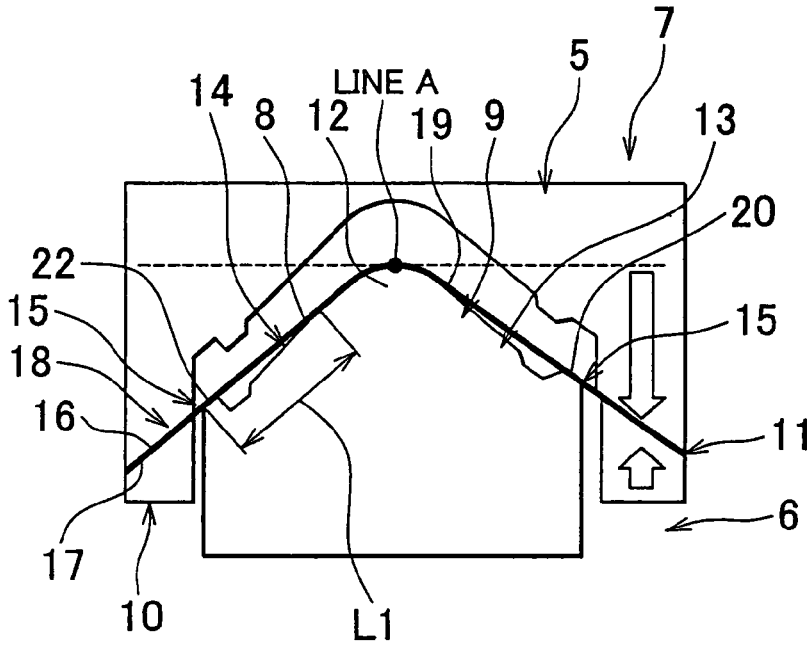
FIG. 5 is the view for describing the press forming device according to the embodiment of the invention, showing the state where a restraint-target portion of the aluminum material has been restrained by a restraining portion.
Figure 6:
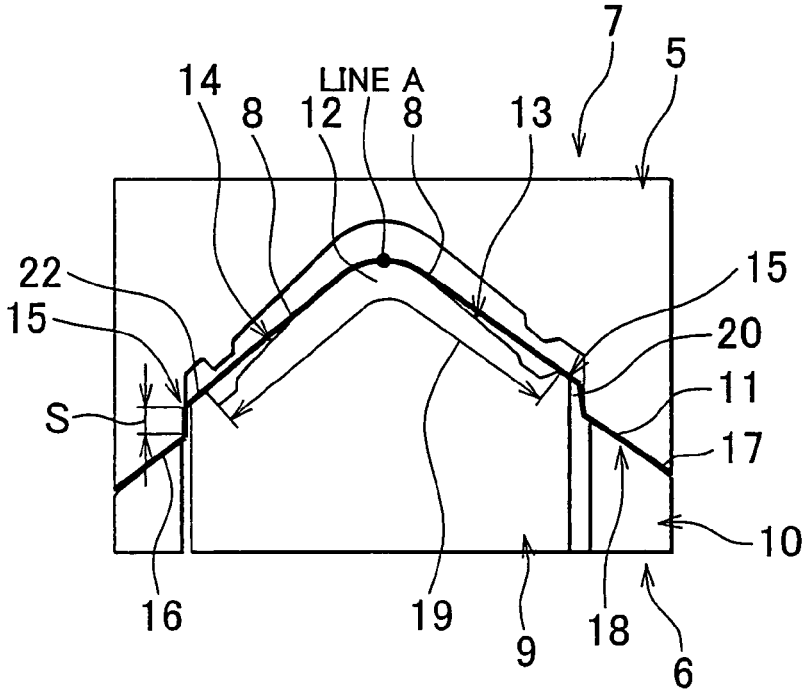
FIG. 6 is the view showing the state where an addendum shape portion of the aluminum material has been drawn using a drawing portion, the state shown in FIG. 6 being realized subsequent to the state shown in FIG. 5.

Also, as shown in FIG. 3, the punch 9 has a first face 13 (one of the forming faces) and a second face 14 (the other forming face) on the respective sides of the line A (on the right side and left side of the line A in FIG. 3). Each of the first face 13 and the second face 14 is tilted by a given tilt angle. From among the forming faces 8, the forming face 8 used to form the plain face portion 3 (one of the faces, see FIG. 1) of the fender panel 1 is formed in the first face 13. From among the forming faces 8, the forming face 8 used to form the side face portion 4 (the other face, see FIG. 1) of the fender panel 1 is formed in the second face 14. In addition, an addendum shape portion support face 22, which is formed into a shape of a frame having a predetermined width, is set along the periphery of the upper portion of the punch 9. As shown in FIG. 5, the press forming die 7 has restraining portions 18 that restrain a restraint-target portion 16 of the aluminum material 11. The restraining portions 18 are tilted by the tilt angles that are equal to the angles by which the first face 13 and the second face 14 of the punch 9 are tilted, respectively. Thus, when the restraint-target portion 16 of the aluminum material 11, which is supported by the lower die 6 so as to be placed along the punch 9, is restrained by the restraining portions 18 (each restraining portion 18 includes a restraining face of the upper die 5 and a die face 17 of the cushion ring 10), the cross section of the aluminum material 11 does not change. Thus, as shown in FIG. 6, the to-be-product portion 19 of the aluminum material 11 and the restraint-target portion 16 of the aluminum material 11 are parallel to each other, while the to-be-product portion 19 of the aluminum material 11 is roughly conformed to the forming faces 8 of the punch 9.

With the press forming device according to the embodiment of the invention, the upper die 5 is moved downward after the restraint-target portion 16 of the aluminum material 11 is restrained by the restraining portions 18. Then, the cushion ring 10 is pressed downward by the upper die 5, and an addendum shape portion 20 set around the to-be-product portion 19 of the aluminum material 11 is drawn by a drawing portion 15 of the press forming die 7 by a drawing amount S, which is equal to or less than the limit to which the aluminum material 11 can be drawn (in the embodiment, the limit to which the aluminum material 11 can be drawn is 200 mm). Thus, as shown in FIG. 6, the aluminum material 11 is elongated and pulled between the line A and the addendum shape portion 20, whereby the to-be-product portion 19 of the aluminum material 11 is roughly conformed to the forming faces 8 of the punch 9. While the to-be-product portion 19 of the aluminum material 11 is roughly conformed to the forming faces 8 of the punch 9, the upper die 5 and the lower die 6 are pressed to each other, whereby a product forming portion 21 is realized in the press forming die 7. Thus, the to-be-product portion 19 of the aluminum material 11 is stretched or drawn by the minimum amount. As a result, the to-be-product portion 19 of the aluminum material 11 is formed into a product shape (fender panel 1), as shown in FIG. 2 and FIG. 7.

Figure 7:
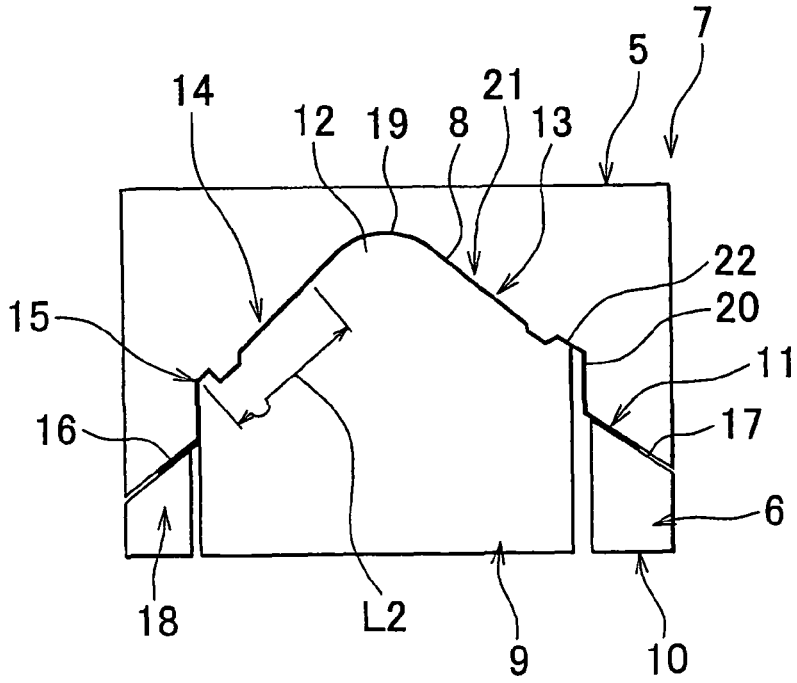
FIG. 7 is the view showing the state where the fender panel has been formed from a to-be-product portion of the aluminum material by a product forming portion which is realized when an upper die and the lower die are pressed to each other, the state shown in FIG. 7 being realized subsequent to the state shown in FIG. 6.

FIG. 5 shows a line-length L1, and FIG. 7 shows a line-length L2. The line-length L1 is a line-length of a predetermined portion of the aluminum material 11, which will undergo the press forming. The line-length L2 is a line-length of the predetermined portion of the aluminum material 11, which has undergone the press forming. With the press forming device according to the embodiment of the invention, the line-length L2 of the predetermined portion of the aluminum material 11, which has undergone the press forming (see FIG. 7), is equal to or less than 1.25 times of the line-length L1 of the predetermined portion of the aluminum material 11, which will undergo the press forming ($L2<L1\times1.25$). Accordingly, cracking in the to-be-product portion 19 of the aluminum material 11 is prevented from occurring during the press forming.

Next, the effects of the press forming device according to the embodiment of the invention will be described. The press forming device is provided with the press forming die 7. At the press forming die 7, the orientation of the fender panel 1 (panel part) is set with respect to the press direction so that the to-be-product portion 19 of the aluminum material 11 is pressed uniformly (the to-be-product portion 19 of the aluminum material 11 is drawn by the minimum amount). First, the aluminum material 11 is placed between the upper die 5 and the lower die 6 so as to be horizontally supported on the lower die 6, while the press forming die 7 is open (while the upper die 5 is at the position at which it has been moved upward to the fullest extent). Next, the upper die 5 is moved downward. Then, the aluminum material 11 is bent along the portion, which will be the bent portion 2 of the fender panel 1, whereby the aluminum material 11 is roughly conformed to the first face 13 and the second face 14 of the punch 9. In this state, as shown in FIG. 5, the restraint-target portion 16 of the aluminum material 11 is restrained (supported) by the restraining portions 18 (each restraining portion 18 includes the restraining face of the upper die 5 and the die face 17 of the cushion ring 10) of the press forming die 7.

Figure 8:
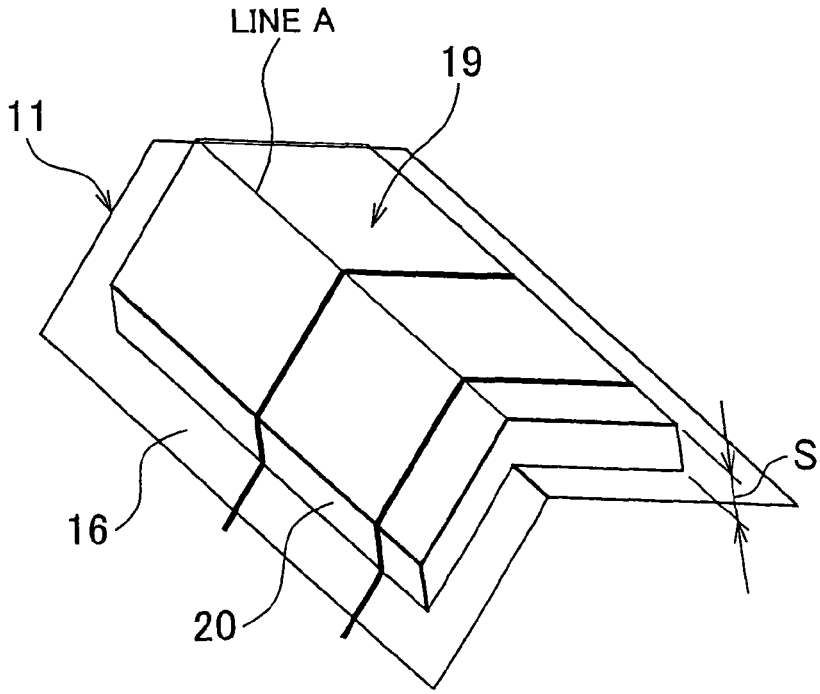
FIG. 8 is the perspective view of the aluminum material in the state shown in FIG. 6.
Figure 9:
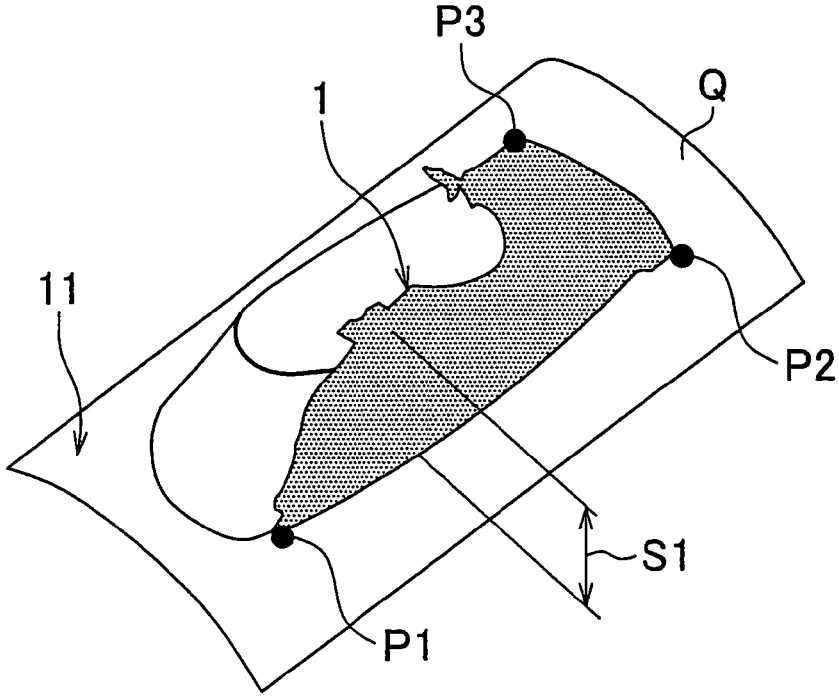
FIG. 9 PRIOR ART
FIG. 9 is the view for describing a conventional method for press-forming a panel part.
Figure 10:
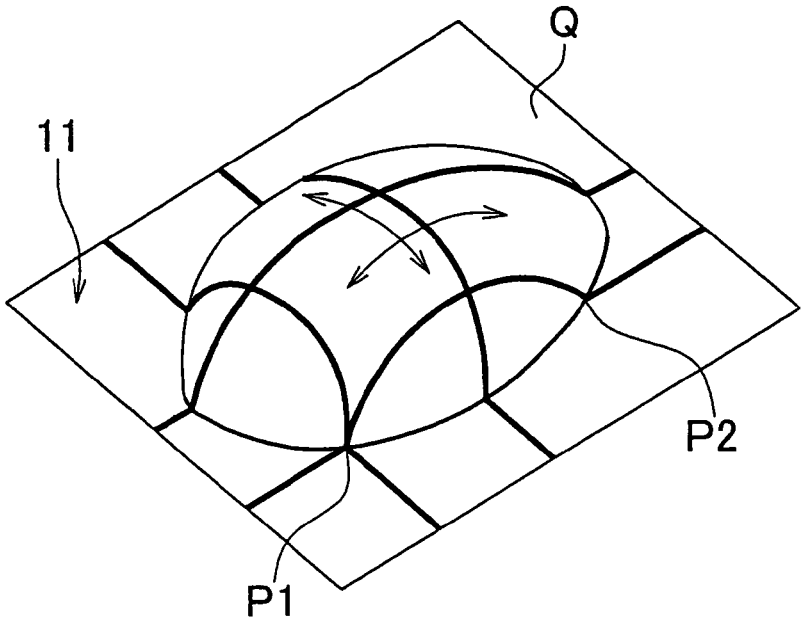
FIG. 10 PRIOR ART
FIG. 10 is the view showing changes in the cross section of a panel part formed by the conventional forming method.

Next, while the restraint-target portion 16 of the aluminum material 11 is restrained, as shown in FIGS. 6 and 8, the cushion ring 10 is pressed downward by the upper die 5, and the addendum shape portion 20 of the aluminum material 11 (the outer portion in the addendum shape portion 20, namely, the portion of the addendum shape portion, which is adjacent to the restraint-target portion 16) is drawn by the drawing portion 15 of the press forming die 7. At this time, the addendum shape portion 20 is drawn by the amount equal to or less than the limit to which the aluminum material 11 can be drawn (in the embodiment, the limit to which the aluminum material 11 can be drawn is 200 mm). Thus, the aluminum material 11 is elongated and pulled between the line A and the addendum shape portion 20, and the to-be-product portion 19 of the aluminum material 11 is roughly conformed to the forming faces 8 of the punch 9. When the addendum shape portion 20 of the aluminum material 11 is drawn by the drawing portion 15 of the press forming die 7, the material flows in the addendum shape portion 20, which may cause crinkling in the addendum shape portion 20 (more specifically, the portion in the addendum shape portion 20, which corresponds to "S" and which has been drawn by drawing portion 15). However, because the crinkling occurs outside the to-be-product portion 19 of the aluminum material 11, it does not affect the quality of the product.

In this state, as shown in FIG. 7, the upper die 5 and the lower die 6 of the press forming die 7 are pressed to each other to realize the product forming portion 21 in the press forming die 7. Thus, the to-be-product portion 19 of the aluminum material 11, which has been roughly conformed to the punch 9, is stretched or drawn. As a result, as shown in FIG. 2, the to-be-product portion 19 is formed into the product shape (fender panel 1).

The embodiment of the invention produces the following effects. The orientation of the fender panel 1 is set with respect to the press direction in which the press forming is performed (the vertical direction in FIG. 2) so that the to-be-product portion 19 of the aluminum material 11 is pressed uniformly (the to-be-product portion 19 of the aluminum material 11 is drawn by the minimum amount). Then, the aluminum material 11 is bent along the portion in the aluminum material 11, which will be the bent portion 2 of the fender panel 1, and roughly conformed to the punch 9 of the press forming die 7. Also, the restraint-target portion 16 of the aluminum material 11 is restrained (supported) by the restraining portions 18 of the press forming die 7. Then, the addendum shape portion 20 of the aluminum material 11 (more specifically, the outer portion in the addendum shape portion 20) is drawn by the drawing portion 15 of the press forming die 7 by the amount that is equal to or less than the limit to which the aluminum material 11 can be drawn. Thus, the aluminum material 11 is elongated and pulled between the line A (see FIG. 3) and the addendum shape portion 20, and the to-be-product portion 19 of the aluminum material 11 is roughly conformed to the forming face 8 of the punch 9. In this state, the upper die 5 and the lower die 6 of the press forming die 7 are pressed to each other to realize the product forming portion 21 in the press forming die 7. Thus, the to-be-product portion 19 of the aluminum material 11, which has been roughly conformed to the punch 9, is stretched or drawn, whereby the fender panel 1 is formed in the to-be-product portion 19.

According to the embodiment of the invention, the to-be-product portion 19 of the aluminum material 11 is stretched or drawn with the to-be-product portion 19 roughly conformed to the forming faces 8 of the punch 9. Accordingly, the cross section of the to-be-product portion 19 uniformly changes by the minimum amount. As a result, inconvenience such as crinkling and crocking does not occur, which makes it possible to produce the fender panel 1 (panel part) having high quality.

According to the embodiment of the invention, the restraining portions 18 (each restraining portion 18 includes the restraining face of the upper die 5 and the die face 17 of the cushion ring 10) are tilted by the tilt angles that are equal to the angles by which the first face 13 and the second face 14 of the punch 9 are tilted, respectively. Accordingly, when the restraint-target portion 16 of the aluminum material 11 is restrained by the restraining portions 18, the cross section of the aluminum material 11 does not change. As a result, occurrence of crinkling in the aluminum material 11 is prevented.

According to the embodiment of the invention, the addendum shape portion 20 is set so as to surround the to-be-product portion 19. Accordingly, flow of the material due to changes in the cross section of the to-be-product portion 19 is absorbed by the addendum shape portion 20. Thus, inconvenience such as crinkling and cracking does not occur in the to-be-product portion 19, which makes it possible to produce the fender panel 1 (panel part) having high quality.

According to the embodiment of the invention, the addendum shape portion 20 of the aluminum material 11 is drawn by the drawing portion 15 of the press forming die 7. Accordingly, even if the material of the addendum shape portion 20 flows and crinkling occurs in the addendum shape portion 20, crinkling does not occur in the to-be-product portion 19 (fender panel 1).

According to the embodiment of the invention, the addendum shape portion 20 is drawn by the amount S which is equal to or less than the limit to which the aluminum material 11 can be drawn. Accordingly, the addendum shape portion 20 does not rupture.

According to the embodiment of the invention, the line-length L2 of the portion of the aluminum material 11, which has undergone the press forming, is equal to or lower than 1.25 times of the line-length L1 of the portion of the aluminum material 11, which will undergo the press forming. Accordingly, cracking does not occur in the to-be-product portion 19 during the press forming.

According to the embodiment of the invention, it is possible to produce, by the press forming, the fender panel 1 made of aluminum base alloy, having a great plane dimension L and high quality. With the press forming device and press forming method according to the embodiment of the invention, flexibility in the design of the panel parts is increased, the panel parts are produced efficiently, and the production cost is significantly reduced as compared to the conventional method.

The embodiment is not limited to the above. For example, the embodiment may be modified as follow.

In the embodiment described above, the fender panel 1 is described as the panel part. However, the invention may be applied to production of any types of panel parts such as a door panel, as long as the panel part is bent along a bent portion, which defines two faces that are contiguous with each other (corresponding to the plain face portion 3 and the side face portion 4 in the embodiment of the invention).

The invention claimed is:

1. A method for press-forming a panel part having a bent portion, comprising the sequential steps of:

bending an unrestrained panel material along a portion, which will be the bent portion of the panel part, so that the panel material is placed along a forming face of a punch;

restraining a restraint-target portion of the panel material, which is set along a periphery of the panel material, with the panel material placed along the forming face of the punch; and stretching or drawing a to-be-product portion of the panel material so that the to-be-product portion is formed into a product shape; wherein drawing an addendum shape portion of the panel material, which is set on an inner side of the restraint-target portion and which surrounds the to-be-product portion of the panel material, by an amount that is equal to or less than a limit to which the panel material can be drawn so that the to-be-product portion of the panel material is roughly conformed to the forming face of the punch and so that crinkling occurs outside the to-be-product portion and does not occur in the to-be-product portion.

2. The method according to claim 1, wherein the restraint-target portion of the panel material is restrained onto a die face that is parallel to a plane extending from the forming face of the punch.

3. The method according to claim 2, wherein the panel material is bent along an apex portion of the punch so that the panel material is divided into two portions that are contiguous with each other.

4. The method according to claim 1, wherein the panel material is bent along an apex portion of the punch so that the panel material is divided into two portions that are contiguous with each other.

5. A press forming device provided with a press forming die that includes an upper die and a lower die, and that forms a panel part having a bent portion, the press forming die comprising:

a restraining portion that restrains a restraint-target portion of a panel material, which is set along a periphery of the panel material, with a portion of the panel material, which will be the bent portion of the panel part, bent along an apex portion of a punch; and a product forming portion that stretches or draws a to-be-product portion of the panel material; wherein the press forming die further comprises:

a support face formed into a shape of a frame having a predetermined width and configured to support an addendum shape portion of the panel material;

a drawing portion that draws the addendum shape portion of the panel material, which is set on an inner side of the restraint-target portion and which surrounds the to-be-product portion of the panel material, by an amount equal to or less than a limit, to which the panel material can be drawn, with the restraint-target portion of the panel material restrained by the restraining portion; wherein the product forming portion that stretches or draws the to-be-product portion of the panel material with the to-be-product portion of the panel material roughly conformed to the punch after the addendum shape portion of the panel material is drawn by the drawing portion so that crinkling occurs outside the to-be-product portion and does not occur in the to-be-product portion.

6. The press forming device according to claim 5, wherein the restraining portion has a die face that is parallel to a plane extending from a forming face of the punch.

7. The press forming device according to claim 6, wherein the punch has two forming faces that are defined by the apex portion which horizontally extends, the product forming portion that forms one of two contiguous faces of the panel part, which are defined by the bent portion, is formed in one of the two forming faces, and the product forming portion that forms the other of the two contiguous faces of the panel part, which are defined by the bent portion, is formed in the other of the two forming faces.

8. The press forming device according to claim 5, wherein the punch has two forming faces that are defined by the apex portion which horizontally extends, the product forming portion that forms one of two contiguous faces of the panel part, which are defined by the bent portion, is formed in one of the two forming faces, and the product forming portion that forms the other of the two contiguous faces of the panel part, which are defined by the bent portion, is formed in the other of the two forming faces.

* * * * *